US007712407B2

(12) United States Patent
Ravid et al.

(10) Patent No.: US 7,712,407 B2
(45) Date of Patent: May 11, 2010

(54) BALLISTIC ARMOR

(75) Inventors: Moshe Ravid, Hod Hasharon (IL); Yoav Hirschberg, M.P. Merom Hagalil (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 542 days.

(21) Appl. No.: 11/404,882

(22) Filed: Apr. 17, 2006

(65) Prior Publication Data

US 2007/0034074 A1 Feb. 15, 2007

(30) Foreign Application Priority Data

Jun. 16, 2005 (IL) ..... 169230

(51) Int. Cl.
*F41H 5/02* (2006.01)

(52) U.S. Cl. ..... 89/36.01; 89/36.02; 89/904; 109/80; 109/81; 109/82; 109/83; 109/84

(58) Field of Classification Search ..... 89/36.01–36.02; 264/349; 109/80–84
See application file for complete search history.

(56) References Cited

U.S. PATENT DOCUMENTS 3,523,057 A 8/1970 Buck
3,705,558 A * 12/1972 McDougal et al. ..... 109/84
3,969,563 A * 7/1976 Hollis, Sr. ..... 428/175
4,061,815 A 12/1977 Poole, Jr.
4,307,140 A 12/1981 Davis
5,361,678 A * 11/1994 Roopchand et al. ..... 89/36.02
5,763,813 A * 6/1998 Cohen et al. ..... 89/36.02
5,972,819 A 10/1999 Cohen
6,112,635 A * 9/2000 Cohen ..... 89/36.02
6,289,781 B1 * 9/2001 Cohen ..... 89/36.02
6,681,400 B1 * 1/2004 Mills ..... 2/2.5
6,826,996 B2 * 12/2004 Strait ..... 89/36.02
2003/0167910 A1 9/2003 Strait
2004/0083880 A1 5/2004 Cohen (Continued)

FOREIGN PATENT DOCUMENTS

DE 39 40 623 A1 6/1991

(Continued)

OTHER PUBLICATIONS

Ko et al., "Behavior of Gradient Designed Composite Under Ballistic Impact." *Proceedings of ICC-11*, vol. II: *Fatigue, Fracture and Ceramic Matrix Composites*, Gold Coast, Australia. Jul. 14-18, 1997.

(Continued)

*Primary Examiner*—Troy Chambers
*Assistant Examiner*—Samir Abdosh
(74) *Attorney, Agent, or Firm*—The Nath Law Group; Susanne M. Hopkins; Ari G. Zytcer

(57) ABSTRACT

A composite armor plate with a layer of pellets in a binder matrix, the pellets having domed front and planar back end and a reduced weight. A method of producing the plate comprises providing front and back layers, applying binder material to the pellets and the layers, and heating the binder material to form the matrix and bind the front and back layers thereto. Each pellet may be coated with a primer adapted to facilitate the binding.

8 Claims, 2 Drawing Sheets

U.S. PATENT DOCUMENTS

2007/0089597 A1* 4/2007 Ma ..... 89/36.02

FOREIGN PATENT DOCUMENTS

| | | | |
|---|---|---|---|
| EP | 0 041 271 | A1 | 12/1981 |
| EP | 0 699 887 | A2 | 3/1996 |
| EP | 0 810 415 | A2 | 12/1997 |
| EP | 1 363 101 | | 4/2003 |
| EP | 1 510 776 | | 3/2005 |
| EP | 1 522 817 | A1 | 4/2005 |
| EP | 1 705 453 | A1 | 9/2006 |
| EP | 1 980 813 | A2 | 10/2008 |
| FR | 2 559 254 | A1 | 8/1985 |
| GB | 1081464 | | 8/1967 |
| GB | 1 260 111 | | 1/1972 |
| GB | 1 352 418 | | 5/1974 |
| GB | 2 272 272 | | 5/1994 |
| IL | 115397 | | 9/1995 |
| WO | 98/15796 | | 4/1998 |

OTHER PUBLICATIONS

Ko et al., "Characterization of Multifunctional Composite Armor." *Proceedings of the American Society for Composites*, Atlanta, Georgia. Oct. 7-9, 1996.

* cited by examiner

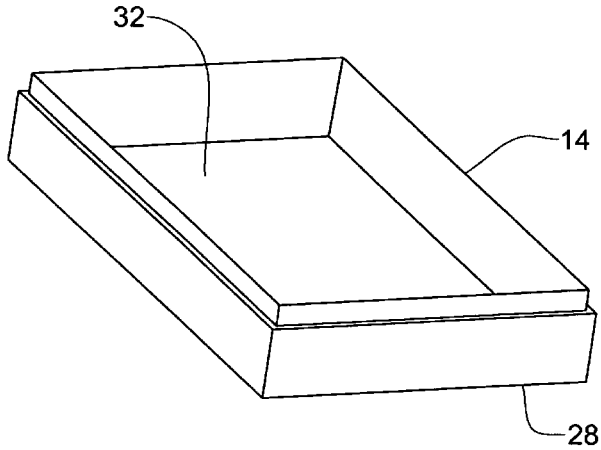
FIG. 2B
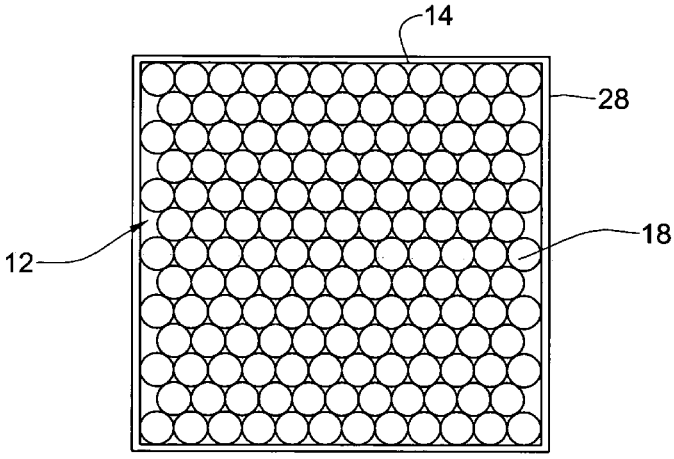
FIG. 2C
FIG. 2D
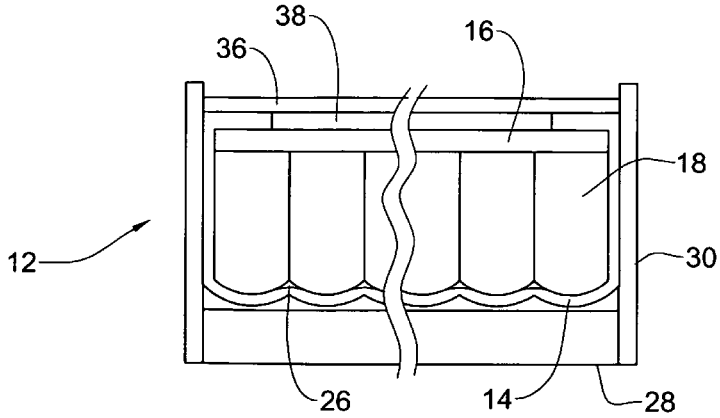

BALLISTIC ARMOR

FIELD OF THE INVENTION

The present invention is directed toward composite ballistic armor, and especially to armor comprising a layer of pellets made of high density material, to provide protection against armor-piercing projectiles, for use as stand-alone armor or as add-on armor.

BACKGROUND OF THE INVENTION

One of the major considerations when designing ballistic armor of the above kind is its weight. Since armor is meant to be carried by a vehicle or worn by a person, armor having a lower weight is preferred to armor of greater weight which provides the same ballistic protection.

Ballistic armor of the kind to which the present invention refers comprises an armor layer of ceramic tough pellets, adapted to absorb most of the energy of the impacting armor-piercing projectiles. The pellets are typically regularly arranged, and held within a matrix of thermoset or thermoplastic material. Such armor normally has high multi-hit capability, since damage to the armor is localized to one or a small number of pellets at the area of impact. The armor typically further comprises front and/or back layers attached to the armor layer.

U.S. Pat. No. 5,763,813 discloses one example of such armor comprising an armor layer of ceramic pellets and a back layer, and the manufacture of the armor layer by use of a vertical mold. After the armor layer has been produced within the mold, the back layer is attached thereto.

In armor layers of the kind described above, the geometry of the pellets contributes to the ballistic protection capability of the layer. It is appreciated that when pellets have domed ends facing a threat, the impact is better absorbed by the armor layer. Cylindrical pellets having such ends are disclosed, for example, in FR 2559254, EP 699887, DE 3940623, U.S. Pat. No. 5,972,819, and EP 1,522,817. Cylindrical pellets disclosed in these publications have both of their ends domed with the same or different radii of curvature, or only the front end facing the threat being domed. The latter design is disclosed, for example, in U.S. Pat. No. 5,972,819, as an alternative to the former configuration, though it is emphasized that the configuration with both domed ends is most preferred.

EP 1,522,817 discloses a composite armor plate for absorbing and dissipating kinetic energy from high-velocity projectiles. The plate comprises a single layer of pellets which are retained by a binder which may be aluminum, thermoplastic polymers or thermoset plastic, such that the pellets are held in direct contact with each other in a plurality of rows and columns. The pellets are made of ceramic material, and are substantially fully embedded in the binder. Each of the pellets is characterized by a cylindrical body having a first and second end faces, each projecting from the body and having an outwardly decreasing cross-sectional area, wherein the height of the end face disposed substantially opposite to an outer impact receiving major surface of the plate is less than 15% of the length of the diameter of the pellet body from which it projects.

SUMMARY OF THE INVENTION

The present invention refers to a number of measures directed to improve ballistic protection provided by a composite armor having a main armor layer comprising a plurality of pellets made of high density material and enveloped in a binder matrix and, preferably, having front and back layers. The pellets may be made of any high density ceramic used in ballistic armor, such as alumina. The binder matrix may be made of a thermoplastic material or a thermoset material. The front and back layers may be made of fibers, preferably in the form of a fabric.

In accordance with one aspect of the present invention, there is provided a composite armor plate having a predetermined ballistic capability which is at least the same as that of a reference panel. The reference panel has a reference weight per unit area and comprising a main armor layer of pellets in a binder matrix. The pellets of the reference panel are made of ballistic material of a high reference density. They have a domed front end and a domed back end and a body portion therebetween having a reference height. The composite armor plate has the same design as the reference panel but with pellets having their back ends planar, the height of their body portions does not exceed the reference height, and the density does not exceed the reference density.

The weight per unit area of the plate is less than the reference weight. The height of the body portions of the plate may be less than the reference height, and the material from which the pellets of the plate are made have a high density which is less than the reference density.

The pellets are preferably coated with primer which is adapted to facilitate binding of the binder matrix to the pellet.

The composite armor plate preferably has at least one additional layer made of a material different from the binder material, constituting a front or back layer of the plate. The main layer and the at least one additional layer are integrally formed, with the binder material forming the matrix and serving to bind the at least one additional layer to the main armor layer. The composite armor preferably has both the front and back layers. Preferably, the at least one additional layer is made from a ballistic fabric. The binder material may be absorbed by the fabric.

In accordance with one aspect of the present invention, the pellets have domed front end adapted to face the ballistic threat, a planar back end, and a body portion therebetween. The body portion may have any regular, e.g. circular, cross-sectional shape, and its area is preferably invariant along the pellet's height including its back end. The front layer is bonded to the domed ends of the pellets, being preferably wrapped around the sides of the plate, and the back layer is bonded to the planar back ends of the pellets.

The armor according to this aspect of the invention has been surprisingly found to have a weight per unit area less than an armor having the same design and providing the same level of ballistic protection but with the pellets having both domed ends and the same height of their body portion. In other words, the armor in accordance with this aspect of the present invention provides a better ballistic protection over an armor having the same design and the same weight but pellets with both domed ends and the same height of their body portion. This surprising quality of the armor in accordance with the first aspect of the invention is in complete contrast with the teachings of U.S. Pat. No. 5,972,819 that it is preferable for the pellets to have both domed portions.

The armor according to this aspect of the invention is preferably produced as an integral body, with the binder material which forms the binder matrix being used to bond the front and back layers to the main armor layer. Armor with this design has a weight per unit area which is less than that of armor of a similar design and providing the same ballistic protection, but the front and back layers being not integrally formed.

In accordance with another aspect of the invention, there is provided a method of producing a ballistic armor, of the kind described above, in the form of a plate by simultaneously forming the main layer and bonding the front and back layers thereto with the same binder material. The method preferably comprises providing a mold of dimensions corresponding to those of the plate, disposing the mold horizontally, arranging the front layer in the interior of mold and along the side walls to form a cavity having sides and a bottom, filling the cavity with pellets in closely packed arrangement, preferably with their domed front ends facing the bottom of the cavity, introducing in the mold the binder so as to fill all the spaces between the pellets and the bottom and sides of the cavity and to cover the planar ends of the pellets, covering the planar ends of the pellets with the back layer, and applying heat to the mold and pressure to the back layer. Such method of production facilitates the application of pressure to the plate and ensures improved contact between the front ends of the pellets and the front layer, and the back ends of the pellets and the back layer, increasing confinement, due to which ballistic protection provided by the armor is improved. Furthermore, the use of ballistic fabric for the front and back layers allows for the binder material to be absorbed therein, which increases the ballistic protection capability of the armor plate. If the binder is introduced as a liquid, the heat should be sufficient to cure the binder. When it is introduced in a powder form, the heat should be sufficient to melt the powder.

Preferably, each pellet is coated with primer on its entire surface. Hereinafter, the term "primer" is to be understood as a coating material adapted to facilitate binding of the binder material to the pellet. The primer may be applied to the pellets before or after their arrangement. It may be applied manually or in an automated fashion.

It should be noted that coating of pellets per se is known from U.S. Pat. No. 5,361,678. However, in that publication, it is disclosed that the coating is used to lessen the effect of thermal shock which may arise during manufacture, which is clearly different from the purpose of the primer according to the present invention.

The mold is preferably made of a material which expands when subject to a rise in temperature. In this case, during manufacture of the armor plate, the mold expands during heating. This allows binder, drawn by the primer, to flow between the pellets, thereby slightly separating the pellets. The pellets are thus spaced between 0.1 and 0.3 mm by the primer and the binder. The introduction of binder between the pellets increases the ballistic protection capability of the armor by reducing propagation of shockwaves through the armor upon impact by a projectile and lessening the effect of shattering pellets on their neighbors. This increases the multi-hit capability of the armor.

According to a further aspect of the present invention, there is provided composite armor comprising pellets in a binder matrix, the pellets being fully coated with primer and binder material, and a method for manufacturing such as armor, including the step of such coating prior to binding the pellets in the matrix.

The armor designed and produced according to different aspects of the present invention appears to be particularly rigid, which increases the ballistic capability thereof. Such rigidity is believe to be a consequence of a synergetic effect of several factors, among which are the following:

- the integral formation of the front and back layers with the main armor layer together the fact that the front and back layers are made of ballistic fabric which has high resistance to stretching;
- the disposition of the pellets in close proximity, while still separated from each other, whereby the movement of adjacent pellets relative to each other is restricted; and
- the use of the primer which ensures that the pellets remain bound to the matrix along their entire side surface, preventing any separation which results in undesirable flexibility of the armor plate.

BRIEF DESCRIPTION OF THE DRAWINGS

In order to understand the invention and to see how it may be carried out in practice, embodiments will now be described, by way of non-limiting examples only, with reference to the accompanying drawings, in which:

FIG. 2B is a perspective view of the mold illustrated in FIG. 2A with a front layer of the armor plate disposed therewithin;

FIG. 2C is a top view of the mold and front layer as seen in FIG. 2B, with pellets arranged therein; and FIG. 2D is a cross-sectional side view of the armor plate shown in FIG. 1, within the mold shown in FIGS. 2A to 2C.

DETAILED DESCRIPTION OF EMBODIMENTS

Figure 1:
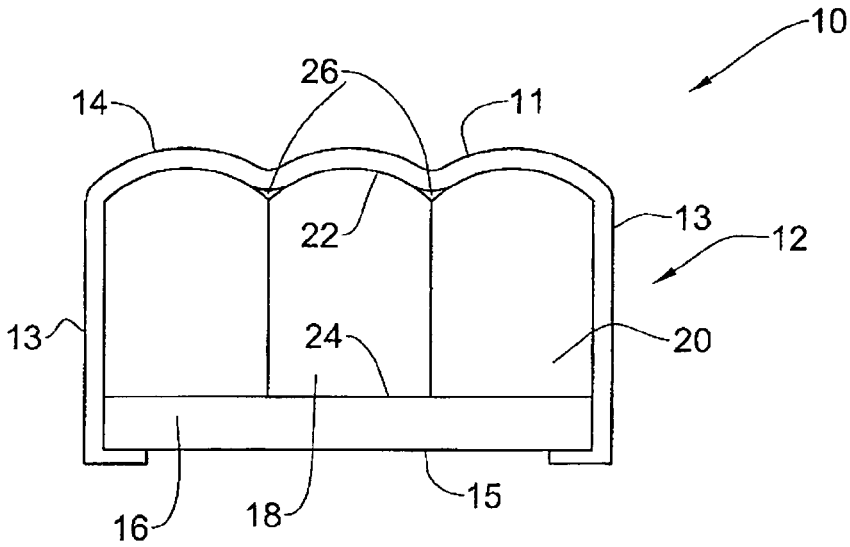
FIG. 1 is a cross-sectional side view of a composite armor plate according to one aspect of the present invention.

FIG. 1 shows one example of a composite armor plate 10 according to the present invention. The plate 10 comprises a main armor layer 12, with a front layer 14 attached in the main layer on one side thereof, to form a front face 11 and side walls 13 of the plate, and a back layer 16 attached to the main layer on its other side, to form a back face 15 of the plate.

The main armor layer 12 comprises an array of pellets 18 made of high density ballistic armor material, e.g., ceramic, such as alumina, silicon carbide, silicon nitride, and boron carbide. Each pellet comprises a cylindrical body 20, a domed front end 22, and a planar back end 24.

The main armor layer 12 further comprises a binder matrix 26 which envelops the pellets and is adapted to retain the arrangement of the array. The matrix may be made of thermoplastic or thermoset material.

The front layer 14 is typically made from a ballistic fabric such as aramid (e.g., KEVLAR™) or fiberglass. It may comprise several sheets of fabric, which may be made of different materials. It constitutes the front face 11 of the armor plate 10, and wraps around the sides of the main armor layer 12. This inter alia provides protection to the main armor layer 12 against moisture and chemical substances, and also functions as a spall liner, preventing exit of shrapnel that results from shattering of pellets upon impact thereon of a projectile. It further provides an aesthetic covering for the armor plate 10.

The back layer 16 is made from a ballistic fabric such as aramid (e.g., KEVLAR™), fiberglass, polyethylene, or other similar material. It may comprise several sheets of fabric, which may be made of different materials. All sheets may be unidirectional, however the one immediately adjacent the pellets is preferably not. The back layer 16 serves to stop projectiles and their fragments as well as shrapnel of pellets that may result from a ballistic projectile impacting the main armor layer 12.

With reference to FIGS. 2A through 2D, the plate 10 may be manufactured as follows:

The pellets 18 are prepared by washing with a surface preparation chemical agent. They are then coated with one or more coats of primer, such as Silan, or any other bonding agent for elastomers. The coating may be accomplished by spraying the pellets 18 with the primer, or by immersion thereof in a bath of the primer. The spraying may be accomplished by standing the pellets 18 on their planar back ends 24, spraying the primer thereon, and allowing them to dry. This coats all surfaces except the back ends 24. When the pellets 18 are later arranged for production with their back ends 24 facing upward, as described below, the primer is applied to the back ends 24, thereby ensuring that the entire surface of each pellet 18 is coated therewith. Alternatively, the entire surface of the pellets may be coated prior to their arrangement for production. The primer may be applied manually or in an automated fashion.

Figure 2A:
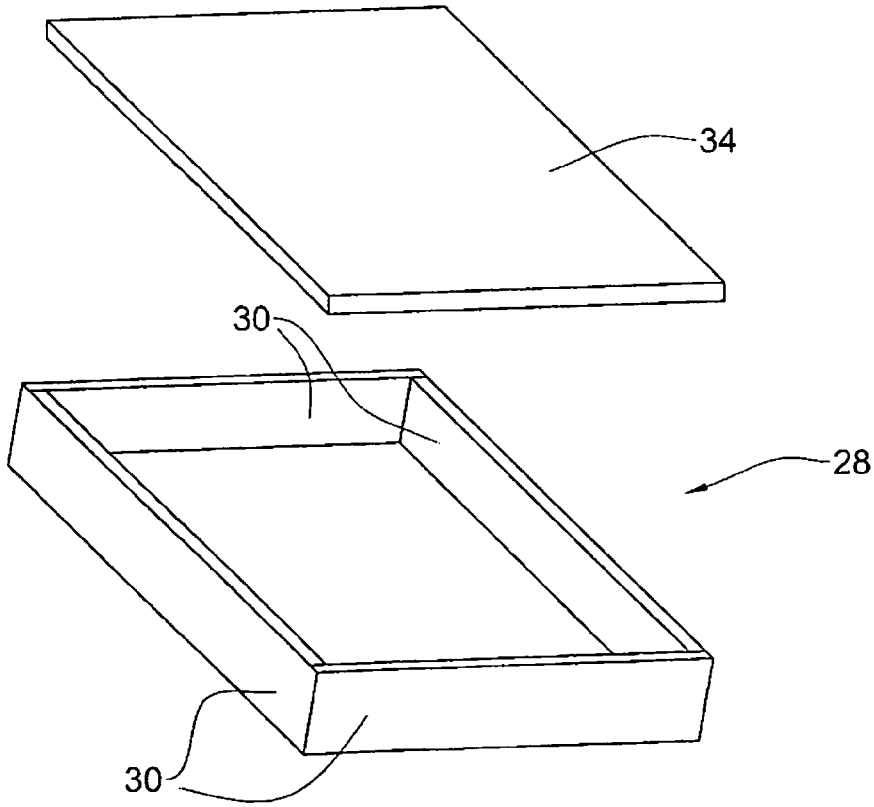
FIG. 2A is a perspective view of a mold for use to manufacture the armor plate shown in FIG. 1.

As seen in FIG. 2A, a mold 28, which may be made of aluminum or other similar material, is provided, having dimensions corresponding to those of the plate 10. The side walls 30 of the mold may be shifted while remaining mutually perpendicular to adjacent walls. A cover 34, associated with the mold, may be provided. It has dimensions which are slightly smaller that those defined by the interior of the side walls 30. As seen in FIG. 2B, the front layer 14 is arranged in a generally horizontal position within the mold 28, and the edges thereof are arranged along the side walls 30 of the mold, forming a cavity 32 having sides and a bottom to correspond, respectively, to the front face 11 and side walls 13 of the armor plate 10. As seen in FIG. 2C, the pellets 18 are arranged within the cavity 32 in a honeycomb or other advantageous arrangement to form the main armor layer 12, with their domed front ends 22 facing the bottom of the cavity 32. The side walls 30 of the mold 28 are shifted until the pellets 18 are tightly packed.

The binder material is introduced in the mold 28 to fill the gaps between the pellets and fully cover them, including the planar back ends 24 thereof. In the event that pellets having a round cross-section are used, the binder can easily reach the front ends of the pellets 18, which are presently disposed downwardly. Due to the domed shape of the front ends 22, binder material covers the entire surface of the pellets and the entire surface area of the front layer 14, increasing adhesion of the front layer to the main armor layer 12. The binder matrix 26 is adapted to bind the pellets 18 to each other and to the adjacent layers.

The back layer 16 is applied to the planar back ends 24 of the pellets 18. Due to flat shape of the pellets 18, the back layer 16 may be easily and smoothly applied to the pellet array. This provides a better attachment of the back layer 16 to the back ends 24 of the pellets 18, increasing the confinement.

Both the front and back layers may be provided with binder material associated therewith. In the event that the binder material is a thermoplastic, the material in powder form may be spread on the each layer before it is introduced into the above process and heated enough so that it binds thereto, while still remaining in powder form. In the event that the binder material is a thermoset, the fabric may be pre-impregnated.

As seen in FIG. 2D, the edges of the front layer 14, which, due to their arrangement in the mold cover the sides of the main armor layer 12, are then wrapped around the back layer 16 near the edges of the plate. Heat and pressure are then applied, which melt the powder, forming thereby the integral plate 10, with the matrix 26 constituting the main armor layer 12 together with the pellets 18, and binding the front and back layers thereto. The cover 34 may be used to distribute the pressure the pellets. Alternatively, the entire mold with the pellets may be covered with plastic and placed inside an autoclave (not shown). In the event that the binder material is a thermoset, and was therefore introduced as a liquid, enough heat needs to be applied to cure the binder material. This is usually at a lower temperature.

The heating expands the mold 28, which allows the pellets 18, which heretofore have been held in contact with one another, to separate slightly by the binder material, whether a thermoplastic or thermoset, at this stage in liquid form, drawn by the primer in-between the pellets 18. When the binder material solidifies, there is produced a gap of 0.1 and 0.3 mm between adjacent pellets 18 at their closest points. This gap contains the primer and the binder material. The presence of the binder between adjacent pellets 18 improves ballistic protection of the armor by reducing propagation of shock-waves through the armor upon impact by a projectile and lessening the effect of shattering pellets on their neighbors.

During the heating, the front layer 14 contracts, thereby at least partially conforming to the shape domed front ends 22, as illustrated in FIG. 1. This increases the confinement of the front layer 14 to the pellets 18, thereby increasing the ballistic performance of the armor.

As illustrated further in FIG. 2D, an optional final backing 36 is applied to the back of the armor. This layer provides a smooth appearance to the armor, and may mainly serve an aesthetic purpose. The gap 38 between the final backing 36 and the backing 16 may be filled in with any material, such as binder or other filler.

Experiments have shown that the plate as described above provides the same ballistic protection capabilities as a reference panel of the same design having higher weight and using pellets having two domed and at least the same height of the body portions.

In one such experiment, a plate according to the present invention and a reference panel were tested. The pellets in the plate were composed of 98% alumina, and each had a diameter of 12.7 mm, a total height of 8 mm, of which 6.5 mm was the height of the cylindrical body portion. The pellets in the reference panel were composed of 99.5% alumina, and each had a diameter of 12.7 mm, a total height of 11.5 mm, of which 7 mm was the height of the cylindrical body portion.

The plate and reference panel each comprised Kevlar™ and fiberglass layers on both ends thereof, and an aluminum panel was disposed therebehind. Ten rounds of 7.62×51 AP projectiles were fired at 840 m/s at both the plate and the reference panel. Each round passed through the respective armor, and the depth of the residual penetration (RP) into the aluminum panel was observed.

The results of the experiment demonstrated that the plate provided substantially the same level of ballistic protection as the reference panel, while weighing considerably less (27 $kg/m^2$ vs. 36.5 $kg/m^2$ for the reference panel).

Experiments further show that the plate as described above provides better ballistic protection capabilities than a reference panel having similar design wherein the front and back layers are not integrally formed with the main armor layer, namely they are attached to the main armor layer after its production.

The armor as described above may be used by itself (stand alone) or, more commonly, mounted to the exterior wall of a vehicle. In the latter case, the wall of the vehicle serves to augment the energy absorbing capability of the back layer, thereby lowering the necessary thickness of the armor. When mounted on a vehicle, an additional liner is typically attached to the inside of the wall, in order to stop fragments and deformed projectiles from entering the vehicle.

Those skilled in the art to which this invention pertains will readily appreciate that numerous changes, variations and modifications can be made without departing from the scope of the invention mutatis mutandis.

The invention claimed is:

1. A method for producing a composite armor plate having front and back faces and side walls therebetween, the method comprising:

(a) providing a plurality of pellets;

(b) providing front and back layers;

(c) applying binder material to the pellets and the layers;

(d) heating the binder material to simultaneously form a matrix, which constitutes with the pellets a main armor layer, and binds the front and back layers to said main armor layer, to form said front and back faces of the composite armor plate; and arranging the front layer in the form of a cavity, before performing the step (c), said cavity having a generally horizontal bottom and generally vertical side walls, corresponding in shape and dimensions to the front face and side walls of the plate, respectively; and arranging the pellets in the said cavity before performing the step (d).

2. The method according to claim 1, wherein the pellets comprise one domed end and one planar end and a body therebetween.

3. The method according to claim 1, wherein at least one of the front and back layers are made of a ballistic fabric.

4. The method according to claim 2, wherein the pellets are arranged so that the domed end of each pellet faces the bottom of a cavity.

5. The method according to claim 1, further comprising wrapping the front layer to cover the sides of the armor plate.

6. The method according to claim 1, further comprising coating the pellets with a primer adapted to facilitate binding of the binder material to the pellets prior to the step (c).

7. The method according to claim 1, wherein the step of applying the binder material comprises applying the binder material between the pellets and the back layer.

8. The method of claim 1, which said step (c) is performed by introducing the binder material in the cavity, and applying the binder material to the back layer; said method further comprising applying the back layer to the back of the arranged pellets.

* * * * *